US006559711B2

(12) United States Patent
Widdershoven et al.

(10) Patent No.: US 6,559,711 B2
(45) Date of Patent: May 6, 2003

(54) CIRCUIT FOR PROVIDING A CONSTANT CURRENT

(75) Inventors: Franciscus Petrus Widdershoven, Eindhoven (NL); Anne Johan Annema, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/902,219

(22) Filed: Jul. 10, 2001

(65) Prior Publication Data

US 2002/0014910 A1 Feb. 7, 2002

(30) Foreign Application Priority Data

Jul. 10, 2000 (EP) ..... 00202449

(51) Int. Cl.[7] ..... G05F 1/10
(52) U.S. Cl. ..... 327/538; 323/315
(58) Field of Search ..... 327/530, 538, 327/94, 541; 323/312, 316, 315

(56) References Cited

FOREIGN PATENT DOCUMENTS

JP 35719211 * 11/1982

* cited by examiner

*Primary Examiner*—Dinh T. Le
(74) *Attorney, Agent, or Firm*—Aaron Waxler

(57) ABSTRACT

Two substantially identical currents ($I_{1,a}$, $I_{1,b}$) are subtracted from each other, while being generated by elements (10, 11) in such a way that noise in the current value of said two currents ($I_{1,a}$, $I_{1,b}$) is determined by shot noise. The differential current, determined only by shot noise, is supplied to a capacitor (13). A second current ($I_2$) is used to charge a second capacitor (22, 29). It is periodically determined whether the value of a voltage across the first capacitor (13) is within or outside a range bounded by the (negative and positive values of the) voltage of the second capacitor (22, 29) which has been charged over the same period of time. The currents ($I_{1,b}$, $I_b$) are set in dependence on the result of the comparison. The signal to set the currents ($I_{1,b}$, $I_b$) also serves as control signal for an element (43) connected as a constant current source. The setting signal and thus the constant current ($I_0$) delivered by the element (43) connected as a current source is to a high degree independent of the temperature sensitivity of different components of the circuit and is determined essentially solely by the ratio of values of similar components (10, 11, 20, 27, 43) of the circuit. By choosing components whose ratio appears in a value of the constant current ($I_0$) delivered by the circuit and which have the same temperature dependence, it is achieved that the temperature dependence disappears completely or substantially completely from the constant current ($I_0$) delivered by the circuit.

22 Claims, 4 Drawing Sheets

CIRCUIT FOR PROVIDING A CONSTANT CURRENT

BACKGROUND OF THE INVENTION

The invention relates to a circuit for providing a constant current.

The invention also relates to a method of providing a constant current.

SUMMARY OF THE INVENTION

Such circuits are known for the generation of a constant current, independently of variations of temperature, supply voltage, etc. They are mainly used in analog circuits for providing a reference signal for the measurement of analog signals, for example in analog-digital converters or digital-analog converters, or for generating a constant supply current for, for example, sensors. Nowadays constant current references are derived from voltage reference circuits, so-called bandgap reference circuits. The conversion of a voltage to a current depends on the accuracy of a resistor or of the combination of a capacitor and a timer circuit for charging the capacitor by means of the voltage reference and discharging it so as to generate the output current. The components which are generally used for converting a reference voltage into a reference current, i.e. resistors and capacitors, have values which are usually temperature-dependent. In addition, the accuracy of a bandgap reference circuit depends on the compensation of temperature-dependent parameters of the circuit by means of other temperature-dependent parameters. Normally, this compensation is accurate only in a limited temperature range.

It is an object of the invention to provide a circuit for supplying a constant current which does not suffer the disadvantages outlined above.

The circuit according to the invention is for this purpose characterized by means for generating a first and a second of two substantially identical currents, means for supplying a differential current which is the difference between said two substantially identical currents to a first capacitor, means for supplying a variable charging current to at least one second capacitor, means for periodically discharging and subsequently charging again the first and the at least one second capacitor, means for generating a clock signal between two periodic discharges, which clock signal is a measure for the difference in voltage across the first and the at least one second capacitor, means for generating a setting signal for setting both the variable charging current and at least one of the two substantially identical currents in dependence of said clock signal, and means for controlling an element connected as a constant current source with a same signal as the setting signal.

The invention is based on the following recognition. An electric current is formed by a flow of electrons (or holes, which will also be referred to as electrons hereinafter). An electron has a charge q. The charge $Q_1$ transported by a current $I_1$ during a time t is equal to $$Q_1=I_1t=qN_1,$$

in which $N_1$ is the number of transported electrons. If the transport mechanism determining $I_1$ is controlled by the mutual independent emission of electrons in a device across an energy barrier higher than a few times $k_B\Theta$ (in which $k_B$ is the Boltzmann constant and $\Theta$ is the absolute temperature), $N_1$ will have a Poisson distribution with the standard deviation $\sqrt{N_1}$. The Poisson distribution may be approximated for high values of $N_1$ by a standard distribution with an expected value $N_1$ and a standard deviation $\sqrt{N_1}$. The standard deviation of $Q_1$ may be written as $$\sigma_{Q1}=q\sqrt{N_1}=\sqrt{qQ_1}=\sqrt{qI_1t}$$

A current to which this type of statistic is applicable is said to have "shot noise". Such a current is the saturated drain current of a MOS transistor which is set for the sub-threshold region, i.e. below the threshold voltage.

The difference $\Delta I_1=I_{1,a}-I_{1,b}$ between two currents $I_{1,a}$ and $I_{1,b}$ having equal expected values $I_1$ but uncorrelated shot noise values, for example such as generated by two MOS transistors set in the same manner, will lead to a fluctuation $\Delta Q_1=Q_{1,a}-Q_{1,b}$. For $N_1=(I_1t/q)>>1$ this fluctuation by approximation has a standard distribution with an expected value zero and a standard deviation $$\sigma_{\Delta Q_1}=(\sqrt{2})\sigma_{Q_1}=\sqrt{2qI_1t}$$

Said $\Delta I_1$ is supplied to an originally discharged capacitor with capacitance $C_1$. A fluctuating voltage $U_1$ then arises across the capacitor with capacitance $C_1$, which voltage by approximation has a standard distribution with an expected value zero and a standard deviation $$\sigma_{U_1}=\sqrt{(2qI_1t)/C_1}$$

In addition to the capacitor with capacitance $C_1$ mentioned above, there is also an originally discharged capacitor with capacitance $C_2$. The capacitor with capacitance $C_2$ is charged by a current $I_2$. The voltage $U_2$ across this capacitor at moment t will be equal to $$U_2=(I_2t)/C_2$$

Provided the unequality $I_2t>>q$ is complied with, the shot noise of $I_2$ can be disregarded. Assuming that a standard distribution holds for $U_1$, the probability that $U_1$ lies in the region $(-U_2, U_2)$ is given by $$P[-U_2<U_1<U_2]=erf((U_2)/((\sqrt{2})\sigma_{U_1}))$$

The function erf (error function) is defined as $$erf(x)=(2/(\sqrt{\pi}))*_0\int^x e^{-y2}dy$$

It will be assumed below for simplicity's sake that the probability P indicated above is equal to 0.5 because this value leads to a simple embodiment of the invention which is yet to be described in more detail. Alternative values of P are also possible and lead to other values of the factor $erf^{-1}$.

The following relation can be derived for the current $I_2$ corresponding to P=0.5 at moment t by means of the relations given above:

$$I_2=(2erf^{-1}(0.5))^2*(I_1/I_2)(C_2/C_1)^2(q/t)=0.91*(I_1/I_2)(C_2/C_1)^2(q/t)$$

in which the function $erf^{-1}$ is the inverse of the error function erf.

For a fixed ratio $I_1/I_2$ the probability $P[-U_2<U_1<U_2]$ is a rising function of $I_2$. The probability P can be kept equal to 0.5 on average by sampling the time-dependent voltages $U_1$ and $U_2$ at a given moment T and subsequently increasing $I_2$ if $U_2$ is smaller than the absolute value of $U_1$ or decreasing $I_2$ if $U_2$ is greater than the absolute value of $U_1$. After sampling, the capacitors $C_1$ and $C_2$ are discharged again, time t is reset to zero, and the capacitors $C_1$ and $C_2$ are charged again with the respective currents $\Delta I_1$ and $I_2$, respectively, during a time period T. The resulting current $I_2$ depends exclusively on the time period T, on the ratio of the capacitances $C_1$ and $C_2$, and on the ratio of the currents $I_1$ and $I_2$. The latter two ratios can be kept constant in general, i.e. independent of temperature, supply voltage, etc., with a high degree of accuracy which is given by the mutually attuned properties of the components used. The time period T can be generated with high accuracy by means of a crystal oscillator or an oscillator with a ceramic resonator. The ratios $I_1/I_2$ and $C_2/C_1$ can be optimized for a fixed value of $I_2T$ so as to occupy a minimum circuit surface area of the integrated circuit in the design of an integrated circuit which uses the circuit according to the present invention.

It was assumed in the above that a comparison is made between the absolute value of the voltage $U_1$ across the capacitor having capacitance $C_1$ and the voltage $U_2$ across the capacitor having capacitance $C_2$. The result of this comparison is a signal whereby the current $I_2$ is increased or decreased in steps.

An alternative algorithm consists in that the difference $|U_1|-U_2$ is used as a measure for the error in a feedback loop which comprises an integrator which integrates the difference $|U_1|-U_2$ continuously, while the capacitors with capacitance values $C_1$ and $C_2$ are periodically discharged in accordance with a given period T. The output of the integrator is then used for controlling the current $I_2$ such that $I_2$ is a continuous and monotonic rising function of the voltage at the output of the integrator.

A feedback loop may be used for keeping the currents $I_{1,a}$ and $I_{1,b}$ equal on average. Provided the feedback loop including said integrator is sufficiently slow, which implies that fluctuations in the error signal are satisfactorily smoothed, the result will be that $|U_1|-U_2$ is kept equal to zero on average. Assuming again that a standard distribution is valid for $U_1$, the expected value of $|U_1|-U_2$ at moment t is given by $$<|U_1|-U_2>=(\sqrt{(2/\pi)})\sigma_{U_1}-U_2=(2/C_1)(\sqrt{(qI_1t/\pi)})-(I_2t/C_2)$$

Starting from this result, the expected value for the error signal averaged over the period T is given by $$\overline{<|U_1|-U_2>}=(4/(3C_1))(\sqrt{(qI_1T/\pi)})-(I_2T/2C_2)$$

As was indicated above, the expected value of the average error signal over period T will be equal to zero. Equalizing the preceding equation to zero yields $$I_2=(64/(9\pi))*(I_1/I_2)(C_2/C_1)^2(q/T)$$

This is comparable to the result based on the algorithm in which the current $I_2$ is changed in steps and in which it is exclusively evaluated whether $I_2$ is greater or smaller than $|U_1|$.

It is apparent from the above that it is possible to generate a constant current $I_2$ which is dependent on the ratio of two currents, the ratio of two capacitances, and a fixed time period. Although it is difficult in practice to lay down exactly a given current value and capacitance of a capacitor, it is not difficult in practice to lay down exactly a ratio of two currents and a ratio of two capacitances, especially in the case of integrated circuits. It is also possible to lay down time intervals with high accuracy by means of clock signals derived from a quartz crystal or a ceramic resonator. In particular, a ceramic resonator renders it possible to lay down time intervals with high accuracy. It is particularly notable that the description given above utilizes the extremely small differential current $\Delta I_1$ of two currents $I_{1,a}$ and $I_{1,b}$ which are comparatively strong. Practical embodiments of circuits in which the algorithms described above are used will be explained in more detail below with reference to FIGS. 1 and 2.

The influence of the temperature on the current $I_2$ has been disregarded up to this point, because it was assumed that the initial voltages at the originally discharged capacitors with capacitances $C_1$ and $C_2$ were equal to zero. The following description, like the preceding description, will start from the assumption that the shot noise of $I_2$ can be disregarded, i.e. it is assumed that $I_2t>>q$. Any noise in the capacitor with capacitance $C_2$ can be disregarded in that case. It will become apparent below, however, that thermal noise in the discharging of the capacitor with capacitance $C_1$ cannot be disregarded.

It is necessary to short-circuit the capacitor with capacitance $C_1$ by means of a switch, for example a MOS transistor, for discharging this capacitor. Such a switch will always have a finite series resistance $R_1$ which generates thermal noise, i.e. Nyquist noise. Said thermal noise has a spectral density in the noise voltage of $4k_B\Theta R_1$. After low-pass filtering by the RC network consisting of $R_1$ and $C_1$, this noise causes a fluctuating voltage across $C_1$ with a variance $$\sigma_{U_1,th}^2={}_0\int^{\infty}(4k_B\Theta R_1)/(1+(2\pi fR_1C_1)^2)df=(k_B\Theta)/C_1$$

in which f is the frequency. The variance is independent of the value of $R_1$. Accordingly, reducing the series resistance of the switch is useless for preventing thermal noise in the originally uncharged capacitors. Reducing the series resistance of the switch does help in speeding up the discharging. After the discharging switch has been opened, a quantity of charge is present in the capacitor with capacitance $C_1$ which is determined by the value of the thermal noise at the moment the switch was opened. This initial thermal noise and the subsequent shot noise are mutually independent. To obtain the variance of the total noise voltage in the capacitor with capacitance $C_1$, the variances of the thermal noise and the shot noise are to be added together:

$$\sigma_{U_1}^2=((2qI_1t)/C_1^2)+((k_B\Theta)/C_1)=(q/C_1)(((2I_1t)/(C_1))+((k_B\Theta)/q))$$

The "thermal noise" $k_B\Theta/q$ at room temperature is approximately 25 mV.

If the first algorithm described above is used, it can be demonstrated that the inclusion of the original thermal noise in the capacitor with capacitance $C_1$ leads to the following corrected result for $I_2$:

$$I_2=2(erf^{-2}(0,5))*(I_1/I_2)*(C_2/C_1)^2*(q/t)*(1+(1+((I_2C_1)^2/(I_1C_2)^2)((C_1k_B\Theta)/(2erf^{-2}(0,5))q^2))^{1/2})$$

This may be written as $$I_2=I_{2,i}+I_{2,d}$$

in which $I_{2,i}$ is the original temperature-independent result for $I_2$ calculated without taking into account the Nyquist noise, and $I_{2,d}$ is the temperature-dependent portion of $I_2$. In the case of a small correction, i.e. the shot noise dominates over the Nyquist noise, $I_{2,d}$ may be approximated in the first order in $\Theta$ by $$I_{2,d}\approx(I_2/I_1)((C_1k_B\Theta)/(2qt))$$

It is apparent from the above that $I_{2,i}$ and $I_{2,d}$ are dependent on the ratio $I_1/I_2$ and on the capacitances $C_1$ and $C_2$ in different manners. This difference can be utilized for making the temperature-dependent term $I_{2,d}$ small in comparison with the temperature-independent term $I_{2,i}$ through a suitable choice of the components of the circuit.

It is possible on the basis of the above description of the currents $I_2$, $I_{2,i}$ and $I_{2,d}$ to construct a current reference which supplies a current which is independent in the first order of the temperature Θ. Two current reference circuits, circuit a and circuit b, are designed for this purpose as described above and yet to be described below in more detail with reference to FIGS. 1 and 2. The current reference circuits a and b have different ratios for $I_{2,d}/I_{2,i}$ and the temperature-dependent, constant currents are combined in the following manner:

$$I_0=I_2^a-((I_{2,d}^a)/(I_{2,d}^b))I_2^b$$

in which the first-order approximations are used for $I_{2,d}^a$ and $I_{2,d}^b$, which leads to $$I_{2,d}^a/I_{2,d}^b=(I_2^a/I_2^b)(I_1^b/I_1^a)(G_1^a/G_1^b)$$

The current $I_0$ no longer has a linear temperature dependence. Since the first-order approximations of $I_{2,d}^a$ and $I_{2,d}^b$ are temperature-dependent, but the quotient of the first-order approximations is temperature-independent, a correction term of the order of $\Theta^2$ is all that remains for the current $I_0$. If the shot noise dominates over the Nyquist noise, this term with a quadratic temperature dependence can generally be made much smaller than the linear terms in $I_2^a$ and $I_2^b$ through a suitable choice of the components.

Following a procedure similar to the one given above in relation to the first algorithm, a temperature-dependent correction term can be found for the current $I_2$ also with the second algorithm. In this case, again, a starting current $I_0$ may be designed which is independent of the temperature in the first order of Θ.

Alternative combinations of the two currents $I_2^a$ and $I_2^b$ may be used for minimizing the temperature dependence, depending on the temperature range.

Algorithms other than the two algorithms described above may be formulated for implementing a balance between a current and the shot noise of this current or of a different current. In addition, more complicated circuits may be designed for eliminating higher-order, for example second-, third-order, etc., temperature-dependent terms in the constant current generated by the circuit.

BRIEF DESCRIPTION OF THE DRAWINGS

The invention will now be explained in more detail with reference to the accompanying drawings, in which.

DETAILED DESCRIPTION OF THE INVENTION

Figure 1A:
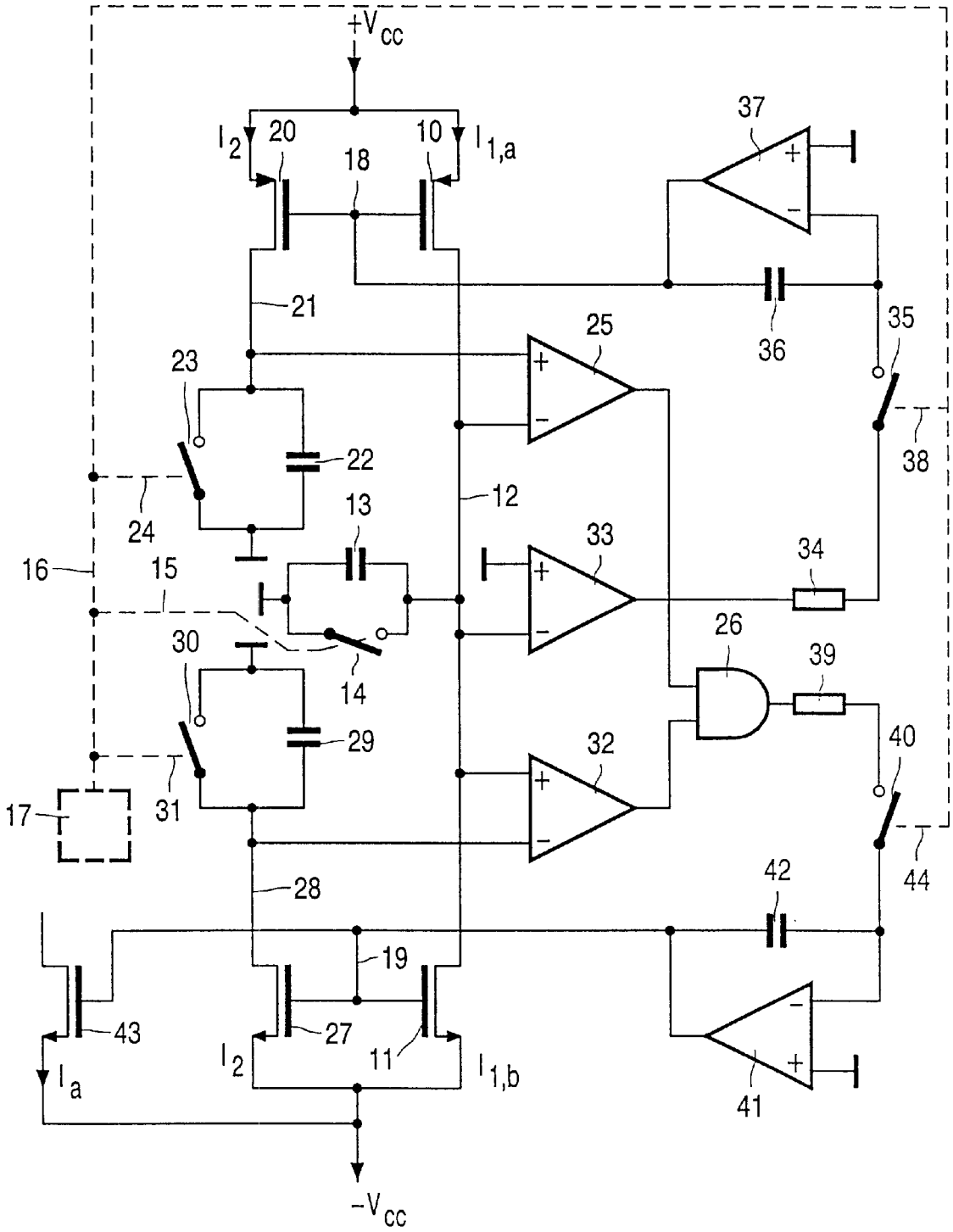
FIG. 1A is an example of a circuit which supplies a constant output current with the use of the first algorithm, which current may yet be dependent on the temperature.

FIG. 1A shows a circuit according to the invention for supplying a constant current $I_0$. The embodiment shown in FIG. 1 assumes that the various MOS transistors and capacitors shown are identical to a high degree, as do the embodiments shown in FIGS. 2 and 3. Such an identicality can be achieved to a high degree if the circuits are constructed as integrated circuits. It will be assumed below that the circuits are constructed as integrated circuits.

The circuit is provided between a supply voltage +Vcc and a supply voltage −Vcc. A P-MOS transistor 10 and an N-MOS transistor 11 are provided between the supply voltages +Vcc and −Vcc in series, the drain of the transistor 10 being directly connected to the drain of the transistor 11 at a junction point 12. A capacitor 13 with capacitance $C_1$ is connected between the junction point 12 and ground. A switch 14 is connected in parallel to the capacitor 13. The switch 14 is an MOS transistor if the circuit is constructed as an integrated circuit. The switch 14 is controlled by a control circuit 17 via a control line 15 coming from a bus 16. The moments at which the switch 14 is operated by control signals on the line 15 and originating from the control circuit 17 so as to open and close will be discussed in more detail below. The gate of the transistor 10 is connected to a junction point 18, and the gate of the transistor 11 is connected to a junction point 19. The junction point 18 is also connected to the gate of a P-MOS transistor 20 whose source is connected to the supply voltage +Vcc. The drain of the transistor 20 is connected to a junction point 21. The junction point 21 is connected to one side of a capacitor 22, whose other side is connected to ground. The junction point 21 is also connected to one side of a switch 23, whose other side is connected to ground. The switch 23 is controlled by control signals originating from the control circuit 17 via a control line 24 coming from the bus 16. The junction point 21 is also connected to the non-inverting input of a comparator 25. The inverting input of the comparator 25 is connected to the junction point 12. The output of the comparator 25 is connected to a first input of an AND gate 26.

The junction point 19 is also connected to the gate of an N-MOS transistor 27. The source of the transistor 27 is connected to the negative supply voltage −Vcc. The drain of the transistor 27 is connected to a junction point 28. The junction point 28 is again connected to a first side of a capacitor 29. The second side of the capacitor 29 is connected to ground. The junction point 28 is also connected to a first side of a switch 30. The second side of the switch 30 is connected to ground. The switch 30 is controlled by signals coming through a control line 21 from the bus 16, which signals are supplied by the control signal generator 17. The junction point 28 is also connected to the inverting input of a comparator 32. The junction point 12 is connected to the non-inverting input of the comparator 32. The output of the comparator 32 is connected to a second input of the AND gate 26. The junction point 12, finally, is connected to the inverting input of a comparator 33. The non-inverting input of the comparator 33 is connected to ground. The output of the comparator 33 is connected to a first side of a resistor 34. The second side of the resistor 34 is connected to a first side of a switch 35. The second side of the switch 35 is connected both to one side of a capacitor 36 and to the inverting input of an operational amplifier 37. The non-inverting input of the operational amplifier is connected to ground. The second side of the capacitor 36 and the output of the operational amplifier 37 are both connected to the junction point 18. The switch 35 is controlled by control signals coming from the bus 16 via control line 38 and originating from the control signal generator 17. The output of the AND gate 26 is connected to a first side of a resistor 39. The second side of the resistor 39 is connected to a first side of a switch 40. The second side of the switch 40 is connected to the inverting input of an operational amplifier 41 and to a first side of a capacitor 42. The second side of the capacitor 42 and the output of the operational amplifier 41 are connected to the junction point 19. The junction point 19 is also connected to the gate of an N-MOS transistor 43. The source contact of the transistor 43 is connected to the negative supply voltage −Vcc. The switch 40 is controlled by control signals over control line 44. The control line 44 comes from the bus 16, and the control signals originate from the control signal generator 17.

Trimming resistors and other trimming elements for the MOS transistors, the comparators and the operational amplifiers have not been shown in FIG. 1A for the sake of clarity.

All MOS transistors shown in FIG. 1A are set for the so-called sub-threshold region, i.e. the region below the threshold voltage, which leads to a saturated drain current. The drain currents obtained in this manner show a type of noise which is known as shot noise.

It is important for the transistors 10 and 11 to have comparable characteristics, apart from the fact that the transistor 10 is a PMOS transistor and the transistor 11 a NMOS transistor. The fact that the transistors always remain in the sub-threshold region in the current range which is relevant is especially important. It is not necessary, however, for the transistors 10 and 11 to have fully identical properties. The same is true for the transistors 20 and 27.

It is of major importance, however, that the transistors 10 and 20 should have identical characteristics, apart from a fixed factor $I_2/I_{1,a}$. This factor, however, should be constant to a high degree. The same holds for the transistors 11, 27, and 43. The ratios $I_2/I_{1,b}$ and $I_0/I_2$ should be constant to a high degree. It is usual to use comparatively large transistors for this which have equal gate lengths but different gate widths. There are also special techniques for positioning the transistors relative to one another such that their equality is further improved. The same current flows through the two transistors 10 and 11, while the junction point 12 is at ground potential on average, which is achieved by means of the feedback loop formed by the comparator 33, the resistor 34, the switch 35, the capacitor 36, the operational amplifier 37, and the transistor 10. The resistor 34, the switch 35, the capacitor 36, and the operational amplifier 37 together form a so-called sample-and-hold circuit, in which the switch 35 is open in the idle state and is only closed under the influence of control signals coming in over the control line 38 from the control signal generator 17 when a new value is to be set for the voltage at junction point 18. Similarly, the resistor 39, the switch 40, the operational amplifier 41, and the capacitor 42 form a sample-and-hold circuit. The switch 40 is open in the idle state, and the switch 40 is closed by means of control signals coming from the control signal generator 17 via the control line 44 when the value of the voltage at the junction point 19 is to be refreshed.

A current $I_{1,a}$ flows through the transistor 10, and a current $I_{1,b}$ flows through the transistor 11. The noise behavior of these two currents is such that shot noise obtains. The difference of these two currents is extremely small and is determined by the shot noise only. The current through the transistor 20 and the current through the transistor 27 are identical as much as possible. A high degree of equality can be achieved in that the circuit is constructed as an integrated circuit. The same holds for the degree of equality of the capacitors 22 and 29. It is also achieved in that case that the current through the transistor 20 for charging the capacitor 22 is equal to a high degree to the current through the transistor 27 for charging the capacitor 29. The value of the current $I_2$ through the transistors 22 and 27 must be comparable to the value of the fluctuating difference in current strength between the currents $I_{1,a}$ and $I_{1,b}$. In practice, the capacitors 22 and 29 will be comparatively large compared with the capacitor 13. The currents $I_{1,a}$ and $I_{1,b}$ and $I_2$ form the currents which have been given the same reference symbols in the introductory passages. The capacitor 13 forms the capacitor having the capacitance value $C_1$, and the capacitors 22 and 29 each form a capacitor having the capacitance value $C_2$.

The description of the operation of the circuit of FIG. 1A starts the moment at which control signals originating from the control signal generator 17 have closed the switches 14, 23, and 30 via the control lines 15, 24, and 31. The capacitors 13, 22, and 29 are fully discharged thereby. The switches 35 and 40 are open and remain open for the present. In practice, a current $I_{1,a}$ is opted for which is equal to the current $I_{1,b}$ but substantially greater than the current $I_2$. The differential current between the currents $I_{1,a}$ and $I_{1,b}$ follows from the shot noises in said currents and ensures that the voltage at junction point 12, being the voltage across the capacitor 13, varies around 0 V with a so-called shot noise behavior. At a moment determined by the control signal generator 17, the switches 14, 23, and 30 are simultaneously opened. From that moment the capacitor 13 is charged by the differential current $\Delta I_1 = I_{1,a} - I_{1,b}$. At the same time, the capacitors 22 and 29 are charged by the current $I_2$. After a time period T, the control signal generator 17 sends a control signal through the bus 16 and the control lines 38 and 44 for closing the switches 35 and 40 for a predetermined period. The voltage across the capacitor 22 has increased in positive direction during the period T, and the voltage across the capacitor 29 has increased in negative direction. The voltage across the capacitor 13 has been fluctuating during this same period T, controlled by the differential current defined by the shot noise in the currents $I_{1,a}$ and $I_{1,b}$. At moment T, by which is meant the moment at the end of the period T after opening of the switches 14, 23, and 30, there are various possibilities for the voltage across the capacitor 13 relative to the voltage across the capacitor 22 and/or the capacitor 29. The value of the voltage across the capacitor 13 may be greater in positive direction than that of the voltage across the capacitor 22, the value of the voltage across the capacitor 13 may be smaller in positive direction than that of the voltage across the capacitor 22 and also smaller in negative direction than that of the voltage across the capacitor 29, or the value of the voltage across the capacitor 13 may be greater in negative direction than that of the voltage across the capacitor 29. If the voltage across the capacitor 13 is greater than the voltage across the capacitor 22 in positive direction at moment T, the output voltage of the comparator 25 will be low, and accordingly the voltage at the output of the AND gate 26 will also be low. The sample-and-hold circuit of which the operational amplifier 41 and the capacitor 42 form part will be set for a slightly higher output voltage via the switch 40 which is closed during the predetermined period, which has the result that the current $I_2$ through the transistor 27 is set for a slightly higher value. Since the control signal for the gate of the transistor 27 originates from the junction point 19, the setting of a slightly higher value of the current $I_2$ also leads to an increase in the current $I_{1,b}$ through the transistor 11. The ratio of the currents $I_{1,b}$ and $I_2$ is determined by the properties of the transistors 27 and 11 and is fully defined, in the case of an integrated circuit with MOS transistors of identical channel lengths, by the width of each of these transistors. Substantially simultaneously with the closing of the switch 40, the switch 35 is also closed under the influence of a control signal on the control line 38 originating from the control signal generator 17. This ensures that a control signal for the gates of the transistors 10 and 20 connected to the junction point 18 causes a control signal to be present at the junction point 18 for the transistor 10 which ensures that the current $I_{1,a}$ is identical to the current $I_{1,b}$. Since the transistors 10 and 11 are identical to a high degree, it follows that the control signals at the junction points 18 and 19 are identical relative to the supply voltages +Vcc and −Vcc. This again has the result that also the current $I_2$ through the transistor 20 is equal to the current $I_2$ through a transistor 27 owing to the high degree of equality of the transistors 20 and 27. After the switches 35 and 40 have been opened again, the switches 14, 23, and 30 are closed for a short period under the influence of control signals coming from the control signal generator 17 along the control lines 15, 24, and 31. After the switches 14, 23, and 30 have subsequently been opened again, the entire cycle described above starts again, but with a slightly higher setting of the current $I_2$ both through the transistor 20 and through the transistor 27.

If the voltage across the capacitor 13 is greater in negative direction (i.e. more strongly negative) than the voltage across the capacitor 29 after the period T has elapsed at moment T, the comparator 32 will give a negative signal to the AND gate 26. In that case the new setting of the current $I_2$, and thus of the currents $I_{1,b}$ and $I_{1,a}$, will lead to a slightly higher current $I_2$ upon closing of the switches 35 and 40.

Finally, if the voltage across the capacitor 13 lies within the region bounded in positive direction by the voltage across the capacitor 22 and in negative direction by the voltage across the capacitor 29, the two comparators 25 and 32 will give a positive signal to the AND gate 26. As a result of this, the voltage at the junction point 19 will drop somewhat upon closing of the switch 40, so that the current $I_{1,b}$ through the transistor 11, the current $I_2$ through the transistor 27, the current $I_{1,a}$ through the transistor 10, and the current $I_2$ through the transistor 20 will drop somewhat.

It is possible in the manner described above to maintain the currents $I_{1,a}$, $I_{1,b}$, and $I_2$ constant to a high degree, using the shot noise in the currents $I_{1,a}$ and $I_{1,b}$, and the comparison of the difference between these two currents with a current $I_2$ which, during charging of a capacitor 22 or 29, does not give rise to a relevant noise in the level up to which said capacitor 22 or 29 is charged.

It follows from the above description that the ratio $C_2/C_1$ of the capacitances of the capacitor 22 or 29 and the capacitor 13 is constant. Furthermore, a correct choice of the transistors 10, 11, 20, and 27 will ensure that the ratio of currents $I_2/I_{1,a}$ or $I_2/I_{1,b}$ is equal to $I_2/I_1$. Since the gate of the transistor 43 is connected to the junction point 19, the gate of the transistor 43 is supplied with the same control signal which is present at the gate of the transistor 11 and at the gate of the transistor 27. Accordingly, the current $I_0$ supplied by the transistor 43 will be constant in the same manner as the currents $I_2$ and $I_1$ are constant. Although each of the components, such as the transistors 10, 11, 20, and 27 and the capacitors 13, 22, and 29 can assume values which are dependent on external circumstances, the current $I_0$ will not be dependent on these same external circumstances, or at least to a much lesser degree, because the current $I_0$, like the current $I_2$, is only dependent on the ratio of the values of the capacitors 22 or 29 and 13 and the currents $I_1/I_2$, as was explained in the introduction above. The ratio of the currents $I_1$ and $I_2$ in the case of an integrated circuit with equal channel lengths depends exclusively on the ratio of the channel widths of the MOS transistors. It is notable that the value of the constant current $I_0$ is thus filly determined by constant ratios, exactly because of the shot noise in the currents $I_{1,a}$ and $I_{1,b}$, which ratios are independent (at least to a very high degree) of external circumstances.

Figure 1B:
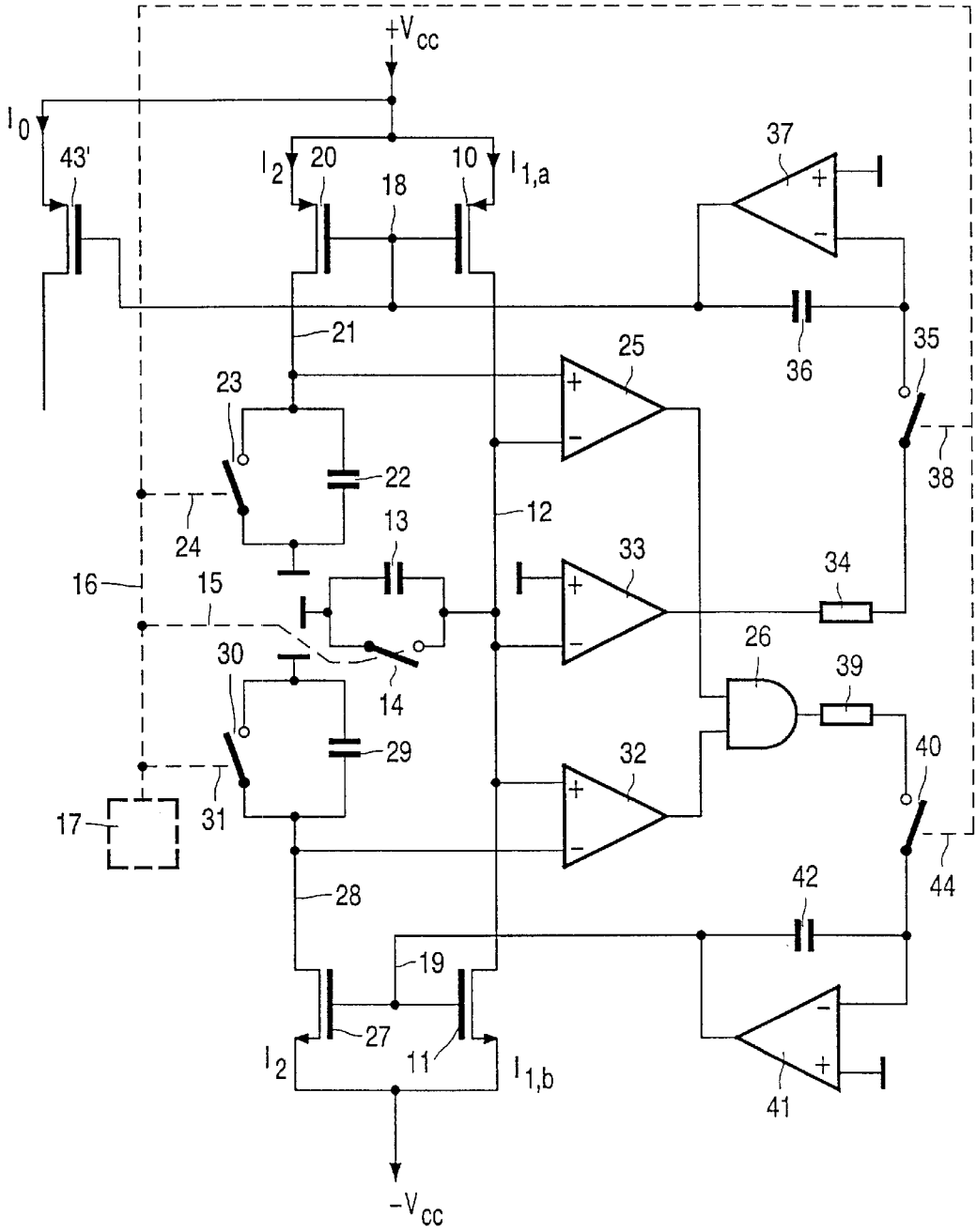
FIG. 1B is a second example of a circuit which supplies a constant output current with the use of the first algorithm, which current may yet be dependent on the temperature.

FIG. 1B shows a circuit which is identical to the circuit shown in FIG. 1A for the major part. Identical elements have been given the same reference numerals. The MOS transistor 43 with its gate connected to junction point 19 and a source connected to the negative supply voltage −Vcc is no longer present. Instead, a MOS transistor 43' is included, whose gate is connected to the junction point 18 and whose source is connected to the positive supply voltage +Vcc.

Reference is made to the description of the operation of the circuit of FIG. 1A for the general operating principle of the circuit shown in FIG. 1B. It is apparent from this description that the setting signal at the junction points 18 and 19 is the same relative to the supply voltage +Vcc and −Vcc, as seen from the gates of the MOS transistors 10 and 20, and 11 and 27, respectively. This is because the currents $I_{1,a}$ and $I_{1,b}$ have to be substantially identical. This equality is achieved by means of the feedback loop formed by the amplifier 33, the resistor 34, the switch 35, the amplifier 37, and the capacitor 36. Similarly, the currents $I_2$ through the transistors 20 and 27 should be identical. This has the result that the signal present at the gate of the transistor 43' ensures that a constant current $I_0$ flows through the MOS transistor 43', which current is equal to the current $I_0$ through the transistor 43 of FIG. 1A (or, depending on the physical dimensions of the transistor 43' with respect to the physical dimensions of the transistor 43, proportional to this current).

Figure 2:
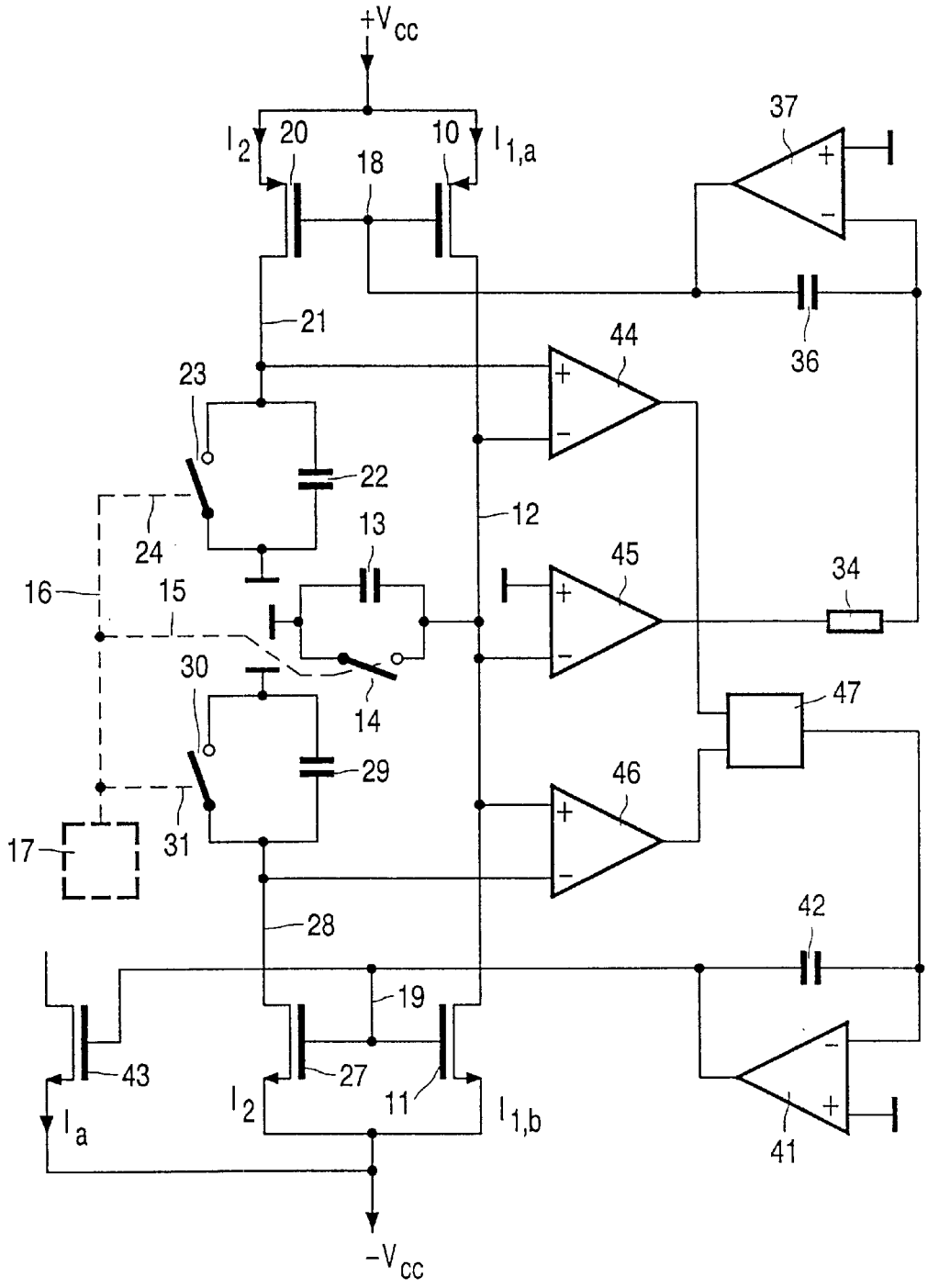
FIG. 2 shows a circuit which supplies a constant output current with the use of the second algorithm, which current may yet be dependent on the temperature.

FIG. 2 shows a circuit which has a strong similarity to the circuit shown in FIG. 1 and which embodies an implementation of the second algorithm described in the introduction. Identical components have been given the same reference numerals in FIG. 1 and FIG. 2 and are not discussed here in any detail. Instead of the comparators 25, 33, and 32, the circuit of FIG. 2 comprises amplifiers 44, 45, and 46, respectively. The switches 35 and 40 are absent and are replaced by through-connections. The AND gate 26 is replaced by a combinatorial circuit 47. The combinatorial circuit 47 is capable of supplying as its output signal a signal which is proportional to the minimum value of the output voltage of the amplifier 44 and of the output voltage of the amplifier 46. It is achieved by means of the differential amplifier 45, the resistor 34, the operational amplifier 37, and the capacitor 36 that a voltage is applied to the junction point 18 such that the transistor 10 ensures that the current $I_{1,a}$ is equal to the current $I_{1,b}$ through the transistor 11 by achieving that a zero value obtains at junction point 12 averaged in time.

The differential amplifiers 44 and 46 in conjunction with the combinatorial circuit 47 ensure that the output signal of the circuit 47 is proportional to the absolute value of the voltage across the capacitor 13 minus the value of the voltage across the capacitor 22 or 29, as applicable. These voltages show a periodic rise from zero, at a moment at which the switches 14, 23, and 30 have discharged the capacitors 13, 22, and 29 and open again, up to a voltage $U_1$ and $U_2$, respectively, at a moment T, whereupon the switches 14, 23, and 30 are operated again by the control signal generator 17 via the control lines 15, 24, and 31 for discharging the capacitors 13, 22, and 29. The combinatorial circuit 47 should accordingly supply a signal which is proportional to the minimum of the output voltages of the differential amplifiers 44 and 46. Often, operational amplifiers with a high gain factor, such as the differential amplifiers 44 and 46, will clip against the supply voltage. This is allowed in the present circuit according to FIG. 2, provided this clipping takes place at the one differential amplifier 44 or 46 while the output voltage of the other differential amplifier 46 or 44 differs less from zero than the clipped output signal of the one differential amplifier 44 or 46, and accordingly there is no influence of the clipped output signal on the output signal of the combinatorial circuit 47. The output signal of the combinatorial circuit 47 is supplied to an integrator formed by the operational amplifier 41 in conjunction with the capacitor 42. The output signal of the integrator formed by the operational amplifier 41 and the capacitor 42 is present at a junction point 19, i.e. at the gate of the transistor 27. The current $I_2$ through the transistor 27 in this manner is a continuous and monotonically rising function of the output signal of the integrator formed by the operational amplifier 41 and the capacitor 42. As was described in the introduction, a constant current $I_2$ is also obtained in this manner. As is the case in the circuit shown in FIG. 1, the transistor 43 controlled by the signal present at the junction point 19 is the supplier of a constant current $I_0$ also in the circuit shown in FIG. 2. If the integrated circuit comprises MOS transistors of equal channel lengths but different widths, the ratio of the currents $I_0/I_2$ is equal to the ratio of the widths of the transistors 43 and 27.

It was noted in the introduction that a temperature dependence of the various components is indeed eliminated in that the eventual constant current $I_0$ is dependent on ratios of two currents and two capacitances which have the same temperature dependence each time. However, the introduction stated that one component exhibits a temperature-dependent noise behavior which is not compensated. This is the capacitor indicated with reference numeral 13 in FIGS. 1 and 2, which is charged by the differential current of the currents $I_{1,a}$ and $I_{1,b}$. A thermal noise voltage is found to be across this capacitor, as described in the introduction, which gives rise to a bias voltage across this capacitor at the moment t=0 upon opening of the short-circuiting switch 14 in FIGS. 1 and 2. This bias voltage originating from the thermal noise will manifest itself in a noise component of the constant current $I_0$.

Figures 3A, 3B:
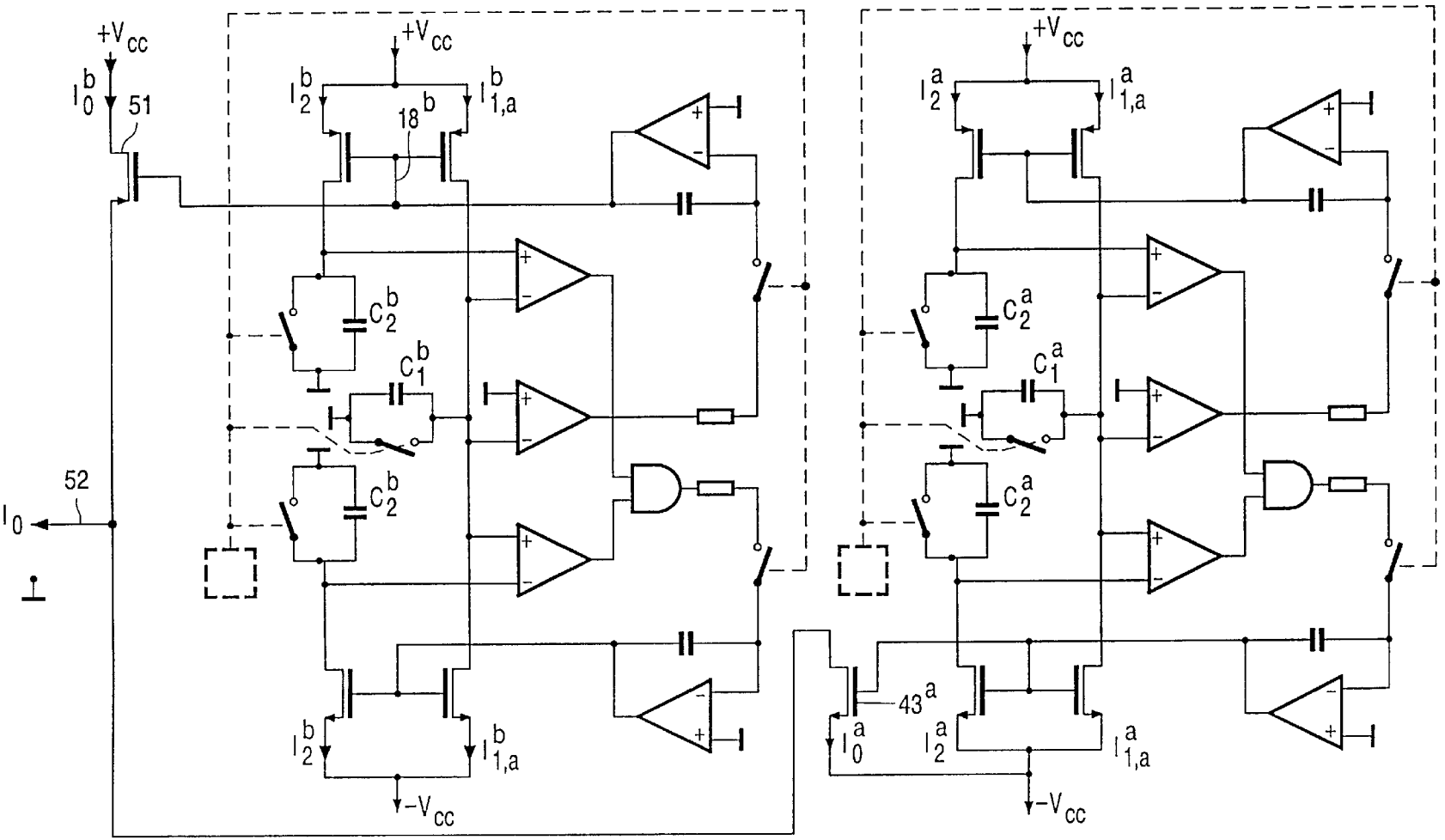
FIG. 3 shows a circuit which supplies a constant current which is independent of the temperature up to the first order.

FIG. 3 shows a circuit based on the description in the introduction which renders it possible to make fluctuations in the constant current $I_0$ independent of linear terms in the temperature. Without limiting the general scope of the invention, FIG. 3 shows two circuits which are constructed in accordance with the circuit of FIG. 1. The two circuits are referenced a and b and will not be described in any detail here. Indicated are the individual currents $I_1$, $I_2$, and $I_0$, as well as the capacitors $C_1$ and $C_2$. In the circuit a, the currents and capacitors have been given the reference $^a$, and in the circuit b the reference $^b$. As is apparent from a comparison with FIG. 1, the equivalent of capacitor 13 is referenced $C^a_1$ or $C^b_1$, as applicable, in FIG. 3, and the equivalent of the capacitors 22 and 29 is referenced $C^a_2$ and $C^b_2$. It is possible to ensure that the ratio $I^a_{2,d}/I^a_{2,i}$ in circuit a differs from the ratio $I^b_{2,d}/I^b_{2,i}$ in circuit b through a choice of certain components with a first value in circuit a and the same components with a second value in circuit b. This is possible, for example, in that a different ratio is chosen for the currents $I_2/I_1$ in circuit a and in circuit b, and/or in that the ratio $C_2/C_1$ in circuit a is chosen to be different from that in circuit b. The output currents $I^a_0$ and $I^b_0$ are not identical as a result of this.

In the circuit shown in FIG. 3, the junction point 18 of the circuit b is connected to the gate of a P-MOS transistor 51 whose source is connected to the positive supply voltage +Vcc. The drain of the transistor 51 is connected to the drain of the transistor 43$^a$ of the circuit a at junction point 52.

The output current appearing at the junction point 52 is accordingly the current $I_0$ which is the difference between the currents $I^b_0$ and $I^a_0$. As was noted in the introduction, it should be ensured that the equation $$I_0=I^a_2-(I^a_{2,d}/I^b_{2,d})I^b_2$$

is complied with. In the first-order approximation in the temperature, the factor in front of the current $I^b_2$ can be calculated from the approximation equation given in the introduction for the current $I_{2,d}$ both for circuit a and for circuit b. The Boltzmann constant, the temperature, the elementary charge, and the time disappear from the ratio from which said factor is built up. What remains in both circuits a and b is a ratio of the currents $I_2$ and $I_1$ and the ratio of the capacitances $C_1$ and $C_2$. This yields a fixed number, and accordingly the factor in front of the current $I^b_2$ is a fixed number, and the value of this current may be simply realized in that the width of the channel of the transistor 51 is adapted such that the current $I^b_0$ through the transistor 51 has the correct value for complying with the above equation. Upon further calculation it appears that the second-order term in the output current $I_0$ of a circuit as shown in FIG. 3, referenced $O(\Theta^2)$ in the introduction, may be written as $$I^b_{2,d}*((I^b_{2,d}/I^b_{2,i})-(I^a_{2,d}/I^a_{2,i})).$$

It may be derived from the expression for the zero-order term in $I_0$, i.e. the temperature-independent term, that the second-order term indicated above is not equal to zero if the zero-order term is not equal to zero, and that this second-order term will have the same sign as the zero-order term. A positive zero-order term in $I_0$ will accordingly correspond to a second-order term with a positive curvature. This will not lead to the smallest error in $I_0$ in a given temperature range. A better result is obtained when the first-order term in $I_0$ is not entirely switched off. It is possible to set the temperature behavior of a positive $I_0$ by means of a small negative first-order term such that $I_0$ will first decrease with an increasing temperature within the relevant temperature range, will reach a minimum in the temperature range, and will subsequently increase again. $I_0$ will reach its maximum value at the boundaries of the temperature range. A maximum absolute deviation from the desired value of $I_0$ can be minimized by a suitable choice of the first-order term.

Many possibilities will now spring to mind to those skilled in the art in view of the above for the design of a circuit which is to supply a constant current and in which components can be used which in themselves have values which are temperature-dependent, while the value of the constant current delivered by the circuit is not temperature-dependent.

What is claimed is:

1. A circuit for providing a constant current ($I_0$), comprising:

means (10, 11) for generating a first ($I_{1,a}$) and a second ($I_{1,b}$) of two substantially identical currents from a voltage source, means (12) for supplying a differential current which is the difference between said two substantially identical currents ($I_{1,a}$, $I_{1,b}$) to a first capacitor (13), means (20,21,27,28) for supplying a variable charging current ($I_2$) to at least one second capacitor (22,29) from the voltage source, means (14, 15, 16, 17, 23, 24, 30, 31) for periodically discharging and subsequently charging again the first (13) and the at least one second (22,29) capacitor, means (25, 26, 32, 35, 38, 39,40,44; 44,46,47) for controlling a time period between two periodic discharges using a clock signal, wherein the time period is a measure for the difference in voltage across the first and the at least one second capacitor, means (41,42; 36,37) for generating a setting signal for setting both the variable charging current ($I_2$) and at least one of the two substantially identical currents ($I_{1,a}$, $I_{1,b}$) in dependence of said time period, and means (19,18) for controlling an output element (43,43') with a same signal as the setting signal, wherein the output element generates a constant current source from one of the two substantially identical currents.

2. A circuit as claimed in claim 1, characterized in that said means for controlling the time period comprise means (16, 17,35,38,40,44) for generating the clock signal at a predetermined moment between two periodic discharges.

3. A circuit as claimed in claim 2, characterized in that said means for controlling the time period comprise at least one comparator (25, 32), and in that said means for generating the setting signal comprise a sample-and-hold circuit (40,41,42,44).

4. A circuit as claimed in claim 1, characterized in that said means for controlling the time period comprise means (36, 37, 41, 42) for continuously generating the clock signal during at least one predetermined time span between two periodic discharges.

5. A circuit as claimed in claim 4, characterized in that said at least one predetermined time span occupies substantially the entire time span between two consecutive periodic discharges.

6. A circuit as claimed in claim 4, characterized in that said means for controlling the time period comprises a circuit (44, 46, 47) which supplies an output signal having a voltage equal to the absolute value of the voltage across the first capacitor (13) minus the value of the voltage across the at least one second capacitor (22, 29), and in that said means for generating the setting signal comprise an integrating circuit (41, 42) for integrating the output signal.

7. A circuit as claimed in claim 6, characterized in that the circuit comprises at least one amplifier for the continuous amplification of the output signal.

8. A circuit as claimed in claim 1, characterized in that a first feedback loop (33, 34, 35, 36, 37, 38, 45) is present for keeping the first ($I_{1,a}$) and the second ($I_{1,b}$) of the two substantially identical currents identical on average.

9. A circuit as claimed in claim 1, characterized in that a control signal originating from the first feedback loop (33, 34, 35, 36, 37, 38, 45) is said same signal.

10. A circuit as claimed in claim 1, characterized in that the means for generating the first ($I_{1,a}$) and the second ($I_{1,b}$) of the two substantially identical currents each comprise a MOS transistor (10, 11) as well as means for biasing the MOS transistor in the sub-threshold region, and in that each of the two ($I_{1,a}$, $I_{1,b}$) substantially identical currents is a saturated drain current of the respective MOS transistor (10, 11).

11. A circuit for supplying a constant current ($I_0$), characterized in that a first (b) and a second (a) circuit associated with the first and second current as claimed in claim 1 is present, in that the first (b) and the second (a) circuit differ in at least one parameter which determines a value of a respective variable charging current ($I_2^a$, $I_2^b$), in that means (18$^b$, 51) are present for generating a mirrored current ($I_0^b$) which mirrored current ($I_0^b$) is the mirrored current of a constant current of the first (b) of the two currents as claimed in claim 1, and in that means (52) are present for obtaining a current which is the difference between the mirrored current ($I_0^b$) and the constant current ($I_0^a$) of the second (a) of the two currents (a, b) as claimed in claim 1.

12. A circuit as claimed in claim 11, characterized in that the at least one parameter is chosen from among: the value of the first capacitor (13), the value of the at least one second capacitor (22, 29), and the values of the two substantially identical currents ($I_{1,a}^a$, $I_{1,b}^a$, $I_{1,a}^b$, $I_{1,b}^b$).

13. A method of providing a constant current ($I_0$), including the steps of:

generating a first ($I_{1,a}$) and a second ($I_{1,b}$) of two substantially identical currents from a voltage source, supplying to a first capacitor (13) a differential current which is the difference of the two substantially identical currents ($I_{1,a}$, $I_{1,b}$), supplying an adjustable charging current ($I_2$) to at least one second capacitor (22,29), by the periodic discharging and subsequent charging of the first (13) and the at least one second capacitor (22,29), controlling a time period between two periodic discharges using a clock signal, wherein the time period is a measure for the difference in voltage across the first (13) and the at least one second capacitor (22,29), generating a setting signal for setting both the adjustable charging current ($I_2$) and at least one of the two substantially identical currents ($I_{1,a}I_{1,b}$) in dependence on the time period, and controlling an output clement (43) by means of a same signal as the setting signal, wherein the output element generates a constant current source from one of the two substantially identical currents.

14. A method as claimed in claim 13, characterized by the generation of the clock signal at a predetermined moment between two periodic discharges.

15. A method as claimed in claim 13, characterized by the continuous generation of the clock signal during at least one predetermined time span between two periodic discharges.

16. A method as claimed in claim 15, characterized in that said at least one predetermined time span occupies substantially the entire time span between two consecutive periodic discharges.

17. A method as claimed in claim 15, characterized by the supply of a voltage for generating the clock signal as an output signal, which voltage is proportional to the absolute value of the voltage across the first capacitor (13) minus the value of the voltage across the at least one second capacitor (22, 29), through integration of the output signal.

18. A method as claimed in claim 17, characterized by the continuous amplification of the output signal.

19. A method as claimed in claim 13, characterized in that the first ($I_{1,a}$) and the second ($I_{1,b}$) of the two substantially identical currents are kept identical on average by means of a first feedback loop (33, 34, 35, 36, 37, 38, 45).

20. A method as claim in claim 13, characterized in that a control signal originating from the first feedback loop (33, 34, 35, 36, 37, 38, 45) is said same signal.

21. A method as claimed in claim 13, characterized by the generation of the first ($I_{1,a}$) and the second ($I_{1,b}$) of the two substantially identical currents each by means of a MOS transistor (10, 11) biased in its sub-threshold region, each of the two substantially identical currents ($I_{1,a}$, $I_{1,b}$) being a saturated drain current of the respective MOS transistor (10, 11).

22. A method of providing a constant current ($I_0$), characterized by the simultaneous twofold implementation of a method as claimed in claim 14, characterized in that the first and the second implementation differ in at least the value of the adjustable charging current ($I_2^a$, $I_2^b$) characterized by the generation of a mirrored current ($I_0^b$), which mirrored current ($I_0^b$) is the mirrored current of the constant current of one of the two methods carried out as claimed in claim 14, and characterized by the creation of a current ($I_0$) which is the difference between the mirrored current ($I_0^b$) and the constant current ($I_0^a$) of the second of the two methods carried out in accordance with claim 14.

* * * * *